US010642195B2

(12) United States Patent
Ishio et al.

(10) Patent No.: US 10,642,195 B2
(45) Date of Patent: May 5, 2020

(54) IMAGE FORMING APPARATUS USING INTERMEDIATE TRANSFER MEMBER HAVING GROOVES AND SPECIFIED DYNAMIC FRICTION COEFFICIENT

(71) Applicant: CANON KABUSHIKI KAISHA, Tokyo (JP)

(72) Inventors: Shohei Ishio, Tokyo (JP); Keisuke Ishizumi, Hiratsuka (JP); Takayuki Tanaka, Tokyo (JP); Tsuguhiro Yoshida, Yokohama (JP); Shinji Katagiri, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/379,571

(22) Filed: Apr. 9, 2019

(65) Prior Publication Data

US 2019/0317431 A1 Oct. 17, 2019

(30) Foreign Application Priority Data

Apr. 16, 2018 (JP) ..... 2018-078712

(51) Int. Cl.
*G03G 15/16* (2006.01)

(52) U.S. Cl.
CPC ..... *G03G 15/161* (2013.01); *G03G 15/162* (2013.01); *G03G 2221/0015* (2013.01)

(58) Field of Classification Search
CPC ..... G03G 15/161; G03G 15/162; G03G 2215/1623; G03G 2215/1661; G03G 2221/0015
USPC ..... 399/101, 302, 308
See application file for complete search history.

(56) References Cited

U.S. PATENT DOCUMENTS 7,144,621 B2 * 12/2006 Tanaka ..... B32B 27/36 428/212
8,824,916 B2 * 9/2014 Hirai ..... G03G 15/0189 399/101
2010/0300604 A1 * 12/2010 Goss ..... B41J 2/0057 156/154
2011/0097104 A1 * 4/2011 Sueoka ..... G03G 15/161 399/101

FOREIGN PATENT DOCUMENTS

JP H04-212190 A 8/1992
JP 04303870 A * 10/1992
JP 2000255821 A * 9/2000 ..... G03G 15/167
JP 2005077667 A * 3/2005

(Continued)

*Primary Examiner* — Robert B Beatty
(74) *Attorney, Agent, or Firm* — Canon U.S.A., Inc. IP Division

(57) ABSTRACT

With respect to a width direction of an intermediate transfer belt perpendicular to a movement direction thereof, the width of a blade is larger than the width of an image forming region in which a toner image is able to be primarily transferred from a photosensitive drum to the intermediate transfer belt. Moreover, grooves are formed on the surface of the intermediate transfer belt, and, with respect to the width direction of the intermediate transfer belt, a dynamic friction coefficient in a first region that is in contact with the end portion side of the blade is smaller than a dynamic friction coefficient in a second region that is in contact with the central portion side of the blade.

12 Claims, 10 Drawing Sheets

(56) References Cited

FOREIGN PATENT DOCUMENTS

| | | | | |
|---|---|---|---|---|
| JP | 2012-018250 | A | | 1/2012 |
| JP | 2012003061 | A | * | 1/2012 |
| JP | 2013-041121 | A | | 2/2013 |
| JP | 2013080121 | A | | 5/2013 |
| JP | 2015125187 | A | | 7/2015 |
| JP | 2016-186581 | A | | 10/2016 |
| JP | 2018-036624 | A | | 3/2018 |

* cited by examiner

IMAGE FORMING APPARATUS USING INTERMEDIATE TRANSFER MEMBER HAVING GROOVES AND SPECIFIED DYNAMIC FRICTION COEFFICIENT

BACKGROUND OF THE DISCLOSURE

Field of the Disclosure

Aspects of the present disclosure generally relate to an image forming apparatus of the electrophotographic type, such as a copying machine or a printer.

Description of the Related Art

In a color image forming apparatus of the electrophotographic type, heretofore, there has been known a configuration using an intermediate transfer method of sequentially transferring toner images from image forming units for respective colors to an intermediate transfer member and then collectively transferring the toner images from the intermediate transfer member to a transfer material.

In such an image forming apparatus, each of the image forming units for respective colors includes a drum-shaped photosensitive member (hereinafter referred to as a "photosensitive drum") serving as an image bearing member. Moreover, as the intermediate transfer member, an intermediate transfer belt, which is formed from an endless belt, is widely used. Toner images formed on the photosensitive drums of the respective image forming units are primarily transferred to the intermediate transfer belt by a voltage being applied from a primary transfer power source to a primary transfer member, which is provided opposite to the photosensitive drum across the intermediate transfer belt. The toner images of the respective colors, which have been primarily transferred from the image forming units for respective colors to the intermediate transfer belt, are collectively secondarily transferred from the intermediate transfer belt to a transfer material, such as a sheet of paper or an overhead projector (OHP) sheet, by a voltage being applied from a secondary transfer power source to a secondary transfer member at a secondary transfer portion. The toner images of the respective colors transferred to the transfer material are then fixed to the transfer material by a fixing unit.

In an image forming apparatus using the intermediate transfer method, after the toner images are secondarily transferred from the intermediate transfer belt to the transfer material, toner (transfer residual toner) remains on the intermediate transfer belt. Therefore, it is necessary to remove the transfer residual toner remaining on the intermediate transfer belt prior to primarily transferring toner images corresponding to the next image to the intermediate transfer belt.

As a cleaning method for removing transfer residual toner, a blade cleaning method is widely used. In the blade cleaning method, transfer residual toner is scraped off by a cleaning blade, which is located at the downstream side of the secondary transfer portion with respect to the movement direction of the intermediate transfer belt and serves as a contact member that is in contact with the intermediate transfer belt, and is thus recovered into a cleaning container. As the cleaning blade, an elastic member such as urethane rubber is usually used. Such a cleaning blade is in many cases located in such a state that the edge portion of the cleaning blade is brought into pressure contact with the intermediate transfer belt from a direction opposite to the movement direction of the intermediate transfer belt (counter direction).

Japanese Patent Application Laid-Open No. 2015-125187 discusses a configuration in which, to prevent or reduce the abrasion of a cleaning blade, grooves extending along the movement direction of an intermediate transfer belt are formed on the surface of the intermediate transfer belt.

From the viewpoint of recoverability of transfer residual toner, with respect to the width direction of the intermediate transfer member, which is perpendicular to the movement direction thereof, the width of the cleaning blade is set larger than the width of an image forming region, in which toner is able to be transferred from the photosensitive drum to the intermediate transfer belt. In a position in which the cleaning blade and the intermediate transfer belt are in contact with each other, at positions which correspond to the inside of the image forming region with respect to the width direction of the intermediate transfer member, toner is supplied to the cleaning blade, so that the cleaning blade is prevented or reduced from being abraded. On the other hand, at positions which correspond to the outside of the image forming region, toner is not supplied to the cleaning blade or only a small amount of toner is supplied thereto, so that the cleaning blade is likely to be abraded.

In a case where the amount of abrasion of the cleaning blade is not even with respect to the longitudinal direction thereof, the attitude of contact of the cleaning blade with the intermediate transfer belt does not become stable, so that toner may pass by the cleaning blade and faulty cleaning may thus occur. Moreover, when the amount of transfer residual toner arriving at the position in which the cleaning blade and the intermediate transfer belt are in contact with each other goes on increasing, in a case where a part of the transfer residual toner has been pushed out to the outside of the image forming region, toner may pass through an abraded part of the cleaning blade. As a result, faulty cleaning may occur.

SUMMARY OF THE DISCLOSURE

Aspects of the present disclosure are generally directed to preventing or reducing the occurrence of faulty cleaning caused by the amount of abrasion of a contact member becoming uneven with respect to the width direction of an intermediate transfer belt perpendicular to the movement direction thereof.

According to an aspect of the present disclosure, an image forming apparatus includes an image bearing member configured to bear a toner image, a movable intermediate transfer member being in contact with the image bearing member and allowing the toner image borne on the image bearing member to be primarily transferred thereto, and a contact member provided at a downstream side of a secondary transfer portion, which secondarily transfers the toner image primarily transferred to the intermediate transfer member from the intermediate transfer member to a transfer material, with respect to a movement direction of the intermediate transfer member, the contact member being in contact with the intermediate transfer member, and being configured to recover toner remaining on the intermediate transfer member after passing through the secondary transfer portion, wherein, with respect to a width direction perpendicular to the movement direction, a width of the contact member is larger than a width of an image forming region in which a toner image is able to be primarily transferred from the image bearing member to the intermediate transfer member, and wherein a plurality of grooves extending along the movement direction is formed on the intermediate transfer member with respect to the width direction, and a dynamic friction coefficient in a first region that is in contact with an end portion side of the contact member with respect to the width direction is smaller than a dynamic friction coefficient in a second region that is in contact with a central portion side of the contact member with respect to the width direction.

Further features and aspects of the present disclosure will become apparent from the following description of example embodiments with reference to the attached drawings.

DESCRIPTION OF THE EMBODIMENTS

Various example embodiments, features, and aspects of the disclosure will now be herein described in detail below with reference to the drawings. However, for example, the dimensions, materials, and shapes of constituent components described in the following embodiments and the relative arrangement therebetween can be changed or altered as appropriate according to the configuration of an apparatus to which the disclosure is applied and various conditions. Accordingly, particularly, unless there is a specific description, those are not intended to limit the scope of the disclosure.

Figure 1:
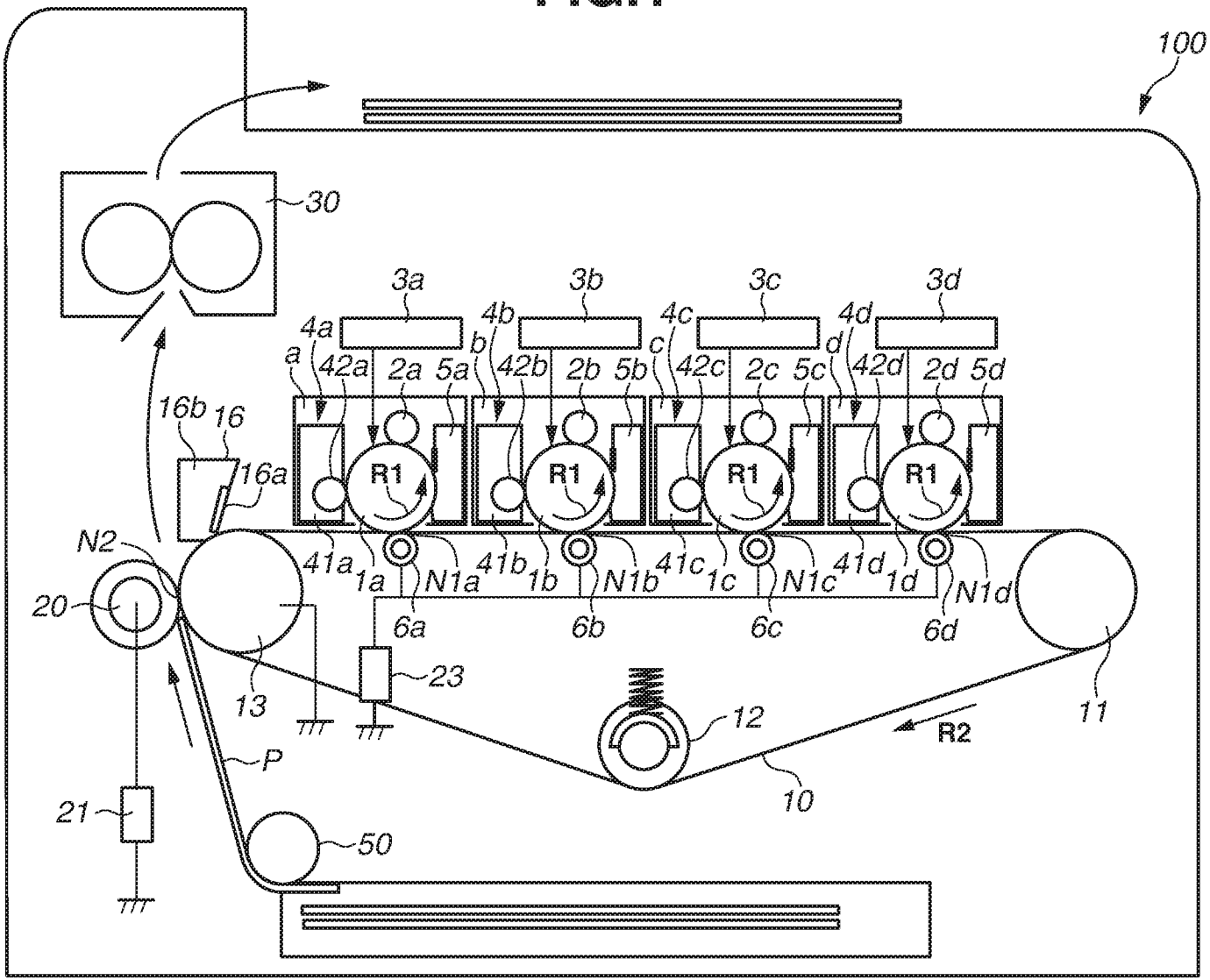
FIG. 1 is an outline sectional view illustrating an example configuration of an image forming apparatus according to a first embodiment.

FIG. 1 is an outline sectional view illustrating a configuration of an image forming apparatus 100 according to a first embodiment. Furthermore, the image forming apparatus 100 according to the first embodiment is what is called a tandem-type image forming apparatus, in which a plurality of image forming units "a" to "d" is provided. The first image forming unit "a" forms an image with use of toner of yellow (Y), the second image forming unit "b" forms an image with use of toner of magenta (M), the third image forming unit "c" forms an image with use of toner of cyan (C), and the fourth image forming unit "d" forms an image with use of toner of black (Bk). These four image forming units are arranged in a row at intervals of a predetermined distance, and most portions of the configurations of the respective image forming units are substantially similar except colors of toners contained in the respective image forming units. Accordingly, hereinafter, the first image forming unit "a" is used to describe the configuration of the image forming apparatus 100 according to the first embodiment.

The first image forming unit "a" includes a photosensitive drum 1*a*, which is a drum-shaped photosensitive member, a charging roller 2*a*, which is a charging member, a developing unit 4*a*, and a drum cleaning unit 5*a*.

The photosensitive drum 1*a* is an image bearing member configured to bear a toner image, and is driven to rotate at a predetermined process speed (in the first embodiment, 200 mm/sec) in the direction of arrow R1 illustrated in FIG. 1. The developing unit 4*a* includes a developing container 41*a*, which contains toner of yellow, and a development roller 42*a*, which bears yellow toner contained in the developing container 41*a* and serves as a developing member for developing a yellow toner image onto the photosensitive drum 1*a*. The drum cleaning unit 5*a* is a unit configured to recover toner adhering to the photosensitive drum 1*a*. The drum cleaning unit 5*a* includes a cleaning blade, which is in contact with the photosensitive drum 1*a*, and a waste toner box, which contains, for example, toner removed from the photosensitive drum 1*a* by the cleaning blade.

When an image forming operations is started by a control unit (not illustrated) receiving an image signal, the photosensitive drum 1*a* is driven to rotate. During the process of rotation, the photosensitive drum 1*a* is uniformly subjected to charging processing by the charging roller 2*a* at a predetermined potential (charging potential) with a predetermined polarity (in the first embodiment, a negative polarity), and then receives exposure light corresponding to an image signal from an exposure unit 3*a*. This forms an electrostatic latent image corresponding to a yellow color component image of the intended color image. Next, the electrostatic latent image is developed by the developing unit 4*a* at a developing position, thus being made visible as a yellow toner image (hereinafter simply referred to as a "toner image"). Here, the normal charging polarity of toner contained in the developing unit 4*a* is a negative polarity. While, in the first embodiment, the electrostatic latent image is subjected to reversal development with toner that is charged at the same polarity as the charging polarity of the photosensitive drum by the development member, the present disclosure can also be applied to an image forming apparatus configured such that the electrostatic latent image is subjected to normal development with toner that is charged at a polarity opposite to the charging polarity of the photosensitive drum.

An intermediate transfer belt 10, which serves as an endless and movable intermediate transfer member, is located at positions at which the intermediate transfer belt 10 is in contact with the photosensitive drums 1*a* to 1*d* of the respective image forming units "a" to "d", and is suspended in a tensioned manner by three axes, i.e., a support roller 11, a tensile suspension roller 12, and a counter roller 13, which are tensile suspension members. The intermediate transfer belt 10 is suspended in a tensioned manner by the tensile suspension roller 12 at a tensile force of 60 N in total pressure, and is moved in the direction of arrow R2 illustrated in FIG. 1 by the rotation of the counter roller 13, which is rotated by receiving a drive force. Furthermore, while the details thereof are described below, the intermediate transfer belt 10 in the first embodiment is configured with a plurality of layers.

In the process of passing through a primary transfer portion N1*a*, at which the photosensitive drum 1*a* and the intermediate transfer belt 10 are in contact with each other, a toner image formed on the photosensitive drum 1*a* is primarily transferred to the intermediate transfer belt 10 by a voltage of the positive polarity being applied from a primary transfer power source 23 to a primary transfer roller 6*a*. Then, toner remaining on the photosensitive drum 1*a* without being primarily transferred to the intermediate transfer belt 10 is recovered by the drum cleaning unit 5*a*, thus being removed from the surface of the photosensitive drum 1*a*.

Here, the primary transfer roller 6*a* is provided at a position corresponding to the photosensitive drum 1*a* across the intermediate transfer belt 10, and serves as a primary transfer member (contact member), which is in contact with the inner circumferential surface of the intermediate transfer belt 10. Moreover, the primary transfer power source 23 is a power source capable of applying a voltage of the positive polarity or negative polarity to the primary transfer rollers 6*a* to 6*d*. While, in the first embodiment, a configuration in which a voltage is applied from a shared primary transfer power source 23 to a plurality of primary transfer members is described, the first embodiment is not limited to this, but the present disclosure can also be applied to a configuration in which a plurality of primary transfer power sources is provided in association with the respective primary transfer members.

Then, in a similar way, a magenta toner image for the second color, a cyan toner image for the third color, and a black toner image for the fourth color are formed and sequentially transferred to the intermediate transfer belt 10 in a superposed manner. This causes toner images of four colors corresponding to the intended color image to be formed on the intermediate transfer belt 10. Then, in the process of passing through a secondary transfer portion, which is formed by a secondary transfer roller 20 and the intermediate transfer belt 10 being in contact with each other, the toner images of four colors borne on the intermediate transfer belt 10 are collectively secondarily transferred to the surface of a transfer material P, such as a sheet of paper or an overhead projector (OHP) sheet, fed by a sheet feeding unit 50.

The secondary transfer roller 20 is a roller with an outer diameter of 18 mm in which a nickel plated steel rod with an outer diameter of 8 mm is covered with a foamed sponge member composed mostly of nitrile-butadiene rubber (NBR) and epichlorohydrin rubber and adjusted to have a volume resistivity of $10^8$ Ω·cm and a thickness of 5 mm. Furthermore, the rubber hardness of the foamed sponge member was measured with use of ASKER Durometer Type C and was 30° in hardness under a load of 500 g. The secondary transfer roller 20 is in contact with the outer circumferential surface of the intermediate transfer belt 10 and is pressed against the counter roller 13, which is located at a position opposite to the secondary transfer roller 20 across the intermediate transfer belt 10, with a pressing force of 50N, thus forming a secondary transfer portion N2.

The secondary transfer roller 20 is driven to rotate by the revolution of the intermediate transfer belt 10, and a voltage being applied from a secondary transfer power source 21 causes a current to flow from the secondary transfer roller 20 toward the counter roller 13. This causes toner images borne on the intermediate transfer belt 10 to be secondarily transferred to the transfer material P at the secondary transfer portion N2. Furthermore, when the toner images borne on the intermediate transfer belt 10 are secondarily transferred to the transfer material P, a voltage to be applied from the secondary transfer power source 21 to the secondary transfer roller 20 is controlled in such a manner that a current which flows from the secondary transfer roller 20 toward the counter roller 13 via the intermediate transfer belt 10 becomes constant. Moreover, the magnitude of a current used for performing secondary transfer is previously determined depending on a surrounding environment in which the image forming apparatus 100 is installed or the type of the transfer material P. The secondary transfer power source 21 is connected to the secondary transfer roller 20, and applies a transfer voltage to the secondary transfer roller 20. Moreover, the secondary transfer power source 21 is able to output a voltage in the range of 100 V to 4,000 V.

Then, the transfer material P, to which the toner images of four colors have been transferred by secondary transfer, is heated and pressed at a fixing unit 30, so that the toner images of four colors are fused and mixed in color and are thus fixed to the transfer material P. Toner remaining on the intermediate transfer belt 10 after secondary transfer is cleaned up and removed by a belt cleaning unit 16 (recovery unit), which is provided at the downstream side of the secondary transfer portion N2 with respect to the movement direction of the intermediate transfer belt 10. The belt cleaning unit 16 includes a cleaning blade 16*a*, which serves as a contact member that is in contact with the outer circumferential surface of the intermediate transfer belt 10 at a position opposite to the counter roller 13, and a waste toner container 16*b*, which contains toner recovered by the cleaning blade 16*a*. Furthermore, in the following description, the cleaning blade 16*a* is simply referred to as a "blade 16*a*".

In the image forming apparatus 100 according to the first embodiment, a full-color print image is formed by the above-described operation.

<Intermediate Transfer Belt 10>

Figure 2:
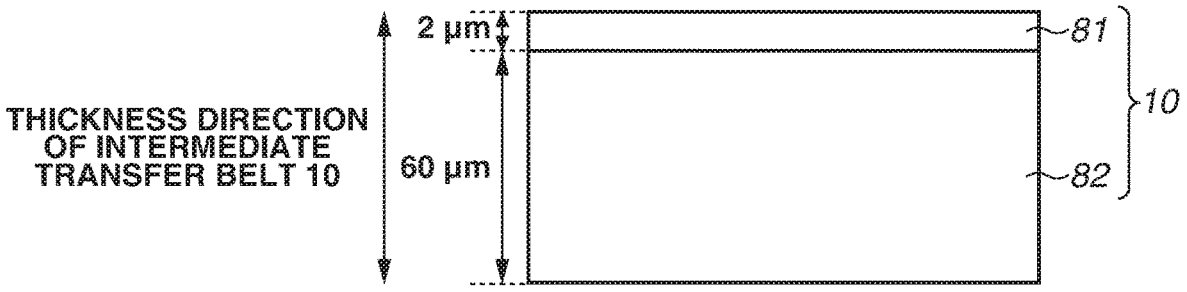
FIG. 2 is a schematic view illustrating an example configuration of an intermediate transfer belt in the first embodiment.

FIG. 2 is a schematic view illustrating a configuration of the intermediate transfer belt 10 in the first embodiment. The intermediate transfer belt 10 in the first embodiment is an endless belt member (or a film-like member) having dimensions of 700 mm in perimeter and 250 mm in width, which intersects with the movement direction of the intermediate transfer belt 10, and is composed of two layers, i.e., a base layer 82 and a superficial layer 81. Here, the term "base layer" is defined as a layer that is thickest among the layers constituting the intermediate transfer belt 10 with respect to the thickness direction of the intermediate transfer belt 10.

As illustrated in FIG. 2, the base layer 82 of the intermediate transfer belt 10 is made from an endless polyethylene terephthalate (PET) resin with a thickness of 60 μm into which an ion conductive agent is blended as a conductive agent. The intermediate transfer belt 10 exhibits characteristics of an ion conductive property and is able to obtain an electrical conduction property due to ions propagating between macromolecular chains, so that, although varying in resistance value with respect to the temperature and humidity of a surrounding environment, the intermediate transfer belt 10 is characterized by being excellent with respect to, for example, unevenness of the resistance value in the circumferential direction thereof. Moreover, the superficial layer 81 is made from acrylic resin, and is formed on the surface of the base layer 82. In the first embodiment, the thickness of the superficial layer 81 was set to 2 μm.

In the first embodiment, in order to prevent or reduce a voltage drop in the intermediate transfer belt 10, such a base layer 82 as to have a volume resistivity of $1\times10^8$ Ω·cm was used. The measurement of the volume resistivity was made with use of Hiresta-UP (MCP-HT450) manufactured by Mitsubishi Chemical Corporation and a ring probe of the type UR (model number MCP-HTP12). Moreover, the measurement thereof was performed under the condition that the indoor temperature was 23° C., the indoor humidity was 50%, the applied voltage was 100 V, and the measurement time was 10 sec.

<Belt Cleaning Unit 16>

Figure 3A:
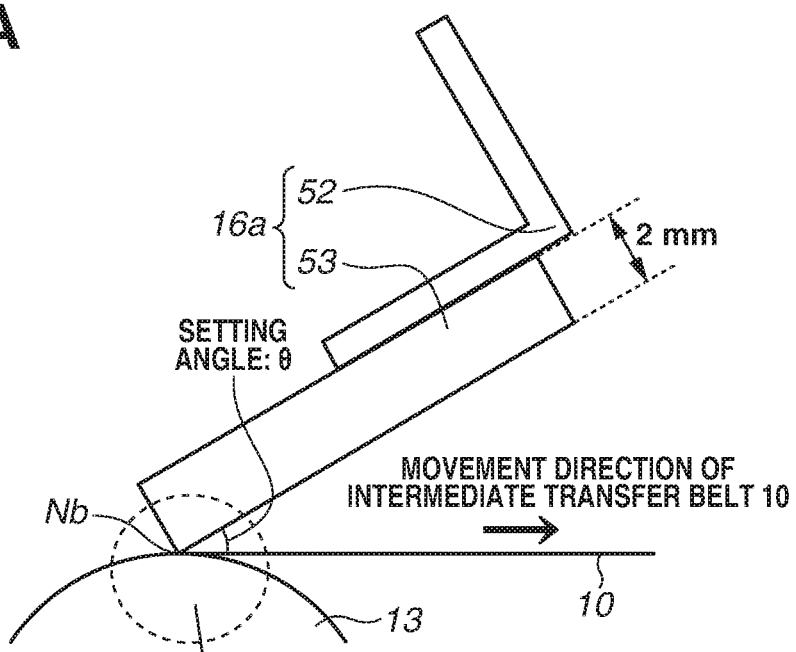
FIGS. 3A and 3B are schematic views illustrating an example configuration of a contact member in the first embodiment.
Figure 3B:
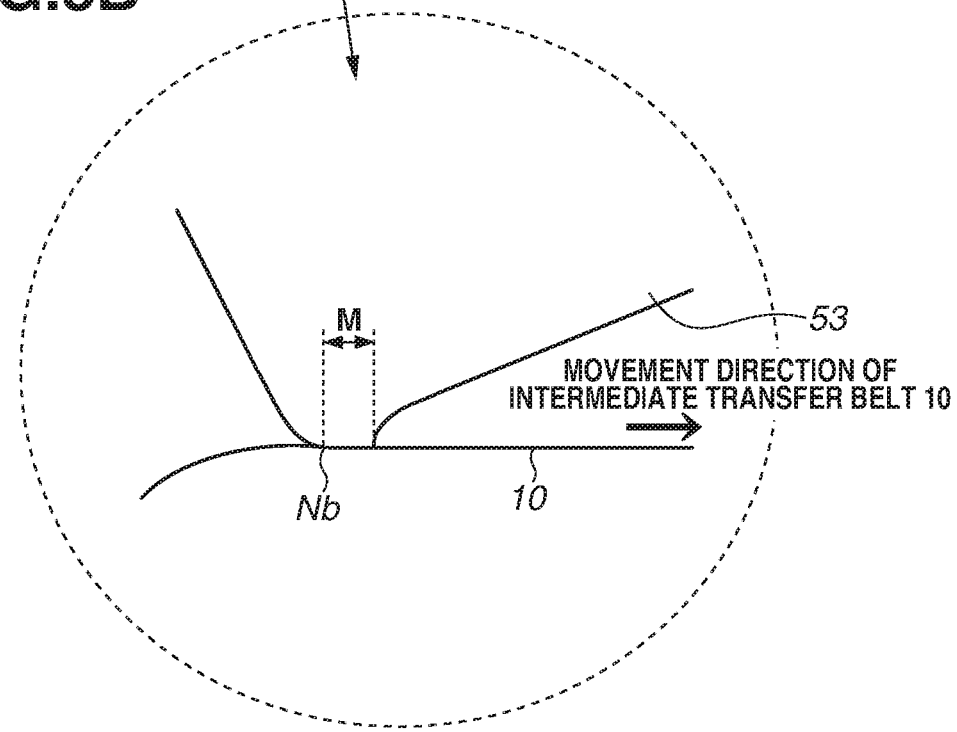

FIG. 3A is a schematic view illustrating a state of contact between the blade 16*a* and the intermediate transfer belt 10, and FIG. 3B is a schematic view illustrating the enlargement of a contact point between the blade 16*a* and the intermediate transfer belt 10. The blade 16*a* in the first embodiment is a plate-like member that is long with respect to the width direction of the intermediate transfer belt 10 (the longitudinal direction of the blade 16*a*), which intersects with the movement direction of the intermediate transfer belt 10 (hereinafter referred to as a "belt conveyance direction").

The blade 16*a* in the first embodiment includes an elastic portion 53, which is in contact with the intermediate transfer belt 10 and scrapes off toner, and a metallic plate portion 52, which supports the elastic portion 53, and the elastic portion 53 is a blade member formed from polyurethane. The blade 16*a* is formed in a blade shape in which the width of the elastic portion 53 in contact with the intermediate transfer belt 10 is 245 mm in length, and is configured with the elastic portion 53 and the metallic plate portion 52 bonded to each other. The elastic portion 53 of the blade 16*a* has a longitudinal width of 245 mm, which is the length with respect to the width direction perpendicular to the movement direction of the intermediate transfer belt 10, a thickness of 2 mm, and a free length of 13 mm, which is the length from a point of bonding with the metallic plate portion 52. Moreover, the hardness of the blade 16*a* is 77 degrees in the JIS K 6253 standard.

The counter roller 13 is located at the inner circumferential side of the intermediate transfer belt 10 in such a way as to be opposite to the blade 16*a*. The blade 16*a* is in contact with the surface of the intermediate transfer belt 10 in a counter direction with respect to the belt conveyance direction at a position opposite to the counter roller 13. In other words, the blade 16*a* is in contact with the surface of the intermediate transfer belt 10 in such a manner that the end portion on the free end side of the blade 16*a* in the transverse direction thereof faces the upstream side with respect to the belt conveyance direction. This forms a blade nip portion Nb between the blade 16*a* and the intermediate transfer belt 10 as illustrated in FIG. 3B. At the blade nip portion Nb, the blade 16*a* scrapes off toner from the surface of the intermediate transfer belt 10, which is moving, and recovers the toner into the waste toner container 16*b*.

In the first embodiment, the blade 16*a* is located with respect to the intermediate transfer belt 10 in such a manner that the setting angle θ is 20° and the intrusion amount δ is 1.5 mm. Here, the setting angle θ is an angle between the tangent line of the counter roller 13 at an intersection point between the intermediate transfer belt 10 and the blade 16*a* (in more detail, the end surface at the free end side thereof) and the blade 16*a* (in more detail, one of surfaces approximately perpendicular to the thickness direction thereof). Moreover, the intrusion amount δ is the length in the thickness direction by which the blade 16*a* overlaps the counter roller 13. Moreover, the contact pressure is defined by a pressing force (a linear pressure in the longitudinal direction) applied from the blade 16*a* at the blade nip portion Nb, and is measured with use of a film-type applied pressure measurement system (product name: PINCH, manufactured by NITTA Corporation). Performing settings in this way enables preventing or reducing turning-up of the blade 16*a* or a slippage sound thereof in a high-temperature and high-humidity environment, thus attaining a good cleaning performance.

As illustrated in FIG. 3B, according to the configuration of the first example embodiment, since the blade 16*a* is located in such a way as to face in the counter direction, the fore-end portion of the blade 16*a* that is in contact with the intermediate transfer belt 10 receives a frictional force with respect to the movement direction of the intermediate transfer belt 10. The frictional force which the fore-end portion of the blade 16*a* receives becomes a force having a direction to bend the fore-end portion of the blade 16*a* following the movement direction of the intermediate transfer belt 10. As a result, due to a frictional force at the contact portion, a contacting part of the blade 16*a* becomes curved as illustrated in FIG. 3B, so that the blade 16*a* becomes shaped in such a way as to be rolled in the intermediate transfer belt 10. The length of a region of the blade 16*a* rolled in the intermediate transfer belt 10 at such a time is defined as the rolled-in amount M.

Furthermore, since the fore-end portion of the blade 16*a* rolled in the intermediate transfer belt 10 due to a frictional force between the blade 16*a* and the intermediate transfer belt 10 applies a pressure to the intermediate transfer belt 10, the blade 16*a* stems toner remaining on the intermediate transfer belt 10. Then, the toner stemmed by the blade 16*a* is recovered into the waste toner container 16*b*. Accordingly, in order to attain the recoverability of toner, the blade 16*a* is kept into contact with the intermediate transfer belt 10 at a predetermined pressure in such a way as to prevent toner from slipping through the blade 16*a*.

However, when the pressure of the blade 16*a* applied to the intermediate transfer belt 10 becomes too high, the frictional force acting on the fore-end portion of the blade 16*a* becomes large, so that the rolled-in amount M of the fore-end portion of the blade 16*a* also becomes large. When the rolled-in amount M becomes too large, such a phenomenon may occur that the blade 16*a*, which is in contact with the intermediate transfer belt 10 in such a way as to face in the counter direction, enters a state of being in contact with the intermediate transfer belt 10 along the movement direction of the intermediate transfer belt 10 (hereinafter referred to as "turning-up"). In a case where turning-up has occurred, since it becomes difficult for the blade 16*a* to stem toner remaining on the intermediate transfer belt 10, faulty cleaning may occur. Accordingly, in order to attain the recoverability of the toner remaining on the intermediate transfer belt 10, it is necessary to appropriately set the rolled-in amount M of the blade 16*a*.

As the method for adjusting the rolled-in amount M of the blade 16*a*, there is a method of adjusting a dynamic friction coefficient of the intermediate transfer belt 10 to adjust a frictional force acting on the fore-end portion of the blade 16*a*. For example, a plurality of grooves extending along the movement direction of the intermediate transfer belt 10 can be provided on the surface of the intermediate transfer belt 10, so that the contact area between the blade 16*a* and the intermediate transfer belt 10 can be reduced and a dynamic friction coefficient between the intermediate transfer belt 10 and the blade 16*a* can be decreased to reduce the frictional force. This enables adjusting the rolled-in amount M of the blade 16*a* with respect to the intermediate transfer belt 10.

In the case of adjusting the dynamic friction coefficient of the intermediate transfer belt 10 by forming grooves on the surface of the intermediate transfer belt 10, the method for forming grooves includes a method of pressing a mold with the shape of grooves formed thereon to the superficial layer 81 of the intermediate transfer belt 10. Moreover, for example, polishing can be used to form recessed and raised portions on the surface of the intermediate transfer belt 10 so as to adjust the dynamic friction coefficient of the intermediate transfer belt 10. In the case of using polishing to form recessed and raised portions on the surface of the intermediate transfer belt 10, for example, a lapping film (Lapika #2000 (product name), manufactured by KOVAX Corporation) is used. The lapping film has fine abrasive particles uniformly dispersed, and is, therefore, able to apply uniform shape impression without forming deep flaws or polishing unevenness, thus enabling polishing to be used to form grooves. The method for forming grooves on the surface of the intermediate transfer belt 10 in the first embodiment is described below in detail.

<Occurrence of Faulty Cleaning Due to Abrasion of Blade>

Figure 4:
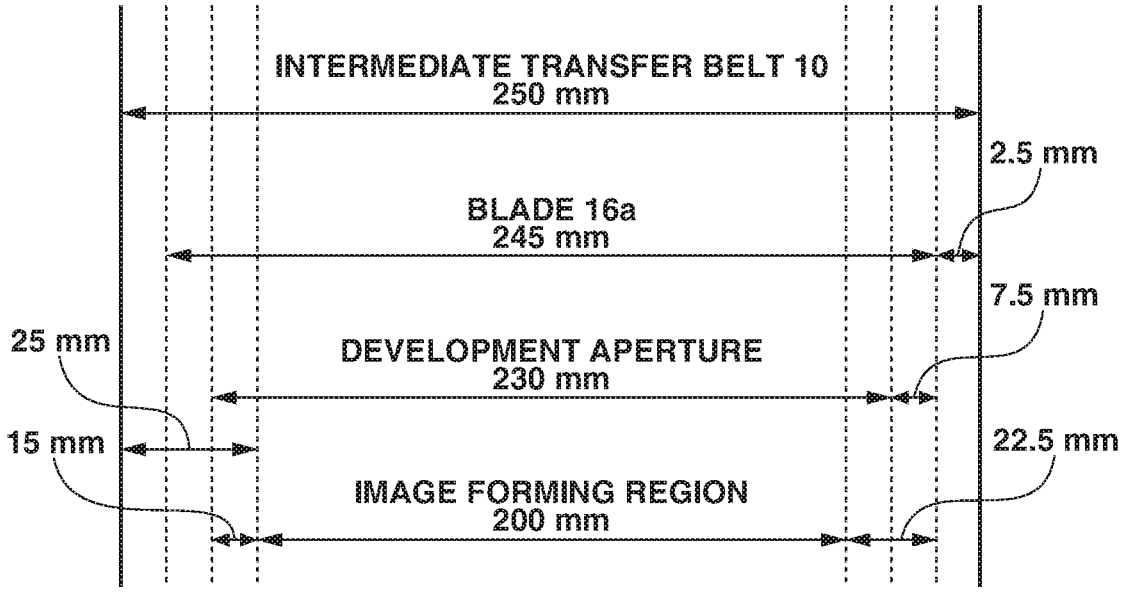
FIG. 4 is a schematic view illustrating longitudinal widths of the respective members and a longitudinal positional relationship between the respective members in the first embodiment.

FIG. 4 is a schematic view illustrating a positional relationship between the respective members with respect to the width direction of the intermediate transfer belt 10 and longitudinal widths of the respective members in the first embodiment. The longitudinal widths of the respective members are set such that, as illustrated in FIG. 4, the intermediate transfer belt 10 is 250 mm, the blade 16*a* is 245 mm, the development aperture is 230 mm, and the image forming region is 200 mm.

Here, the development aperture (aperture portion) is a region in which toner contained in the developing container 41*a* is allowed to contact the development roller 42*a*, and corresponds to the width over which toner is supplied from the developing unit 4*a* to the photosensitive drum 1*a*. More specifically, in the case of one-component-type contact development, the development aperture refers to a region in which toner is applied to coat the development roller 42*a*. Moreover, the image forming region refers to a region in which an image is able to be formed in response to an instruction from a control unit (not illustrated).

As illustrated in FIG. 4, with respect to the width direction of the intermediate transfer belt 10, the width of the blade 16*a* is larger than each of the widths of the image forming region and the development aperture. Since toner is supplied to the inside of the image forming region during, for example, image formation, toner remaining on the intermediate transfer belt 10 after secondary transfer is supplied to the blade nip portion Nb corresponding to the inside of the image forming region. Moreover, in a region inside the development aperture, although toner is unlikely to be supplied during image formation, toner adhering to the development roller 42*a* from the developing container 41*a* may in some cases move to the intermediate transfer belt 10 via the photosensitive drum 1*a*. In other words, not as much as the inside of the image forming region, toner may be slightly supplied to the blade nip portion Nb outside the image forming region and corresponding to a region inside the development aperture with respect to the width direction of the intermediate transfer belt 10. On the other hand, toner is hardly supplied to the blade nip portion Nb corresponding to a region outside the development aperture.

As illustrated in FIG. 4, the end portion side in the longitudinal direction of the blade 16*a* at each of both ends is a region outside the image forming region by 22.5 mm and is thus a region in which the amount of supply of toner is small. In other words, in the region corresponding to 22.5 mm at the end portion side in the longitudinal direction of the blade 16*a*, the frictional force becomes larger than that in the region corresponding to the inside of the image forming region and, thus, the rolled-in amount M of the blade 16*a* becomes large, so that the blade 16*a* becomes likely to be worn. As a result, with respect to the width direction of the intermediate transfer belt 10, the amount of abrasion of the blade 16*a* may become different depending on the longitudinal position of the blade 16*a*, so that faulty cleaning may occur.

For example, in a case where the rolled-in amount M of the blade 16*a* is not even with respect to the longitudinal direction, the contact attitude of the blade 16*a* with respect to the intermediate transfer belt 10 does not become stable, so that toner may pass through the blade 16*a*. Moreover, as the amount of toner arriving at the blade nip portion Nb increases, in a case where a part of toner has been pushed out to outside the image forming region at the blade nip portion Nb, toner may pass through an abraded portion of the blade 16*a*. As a result of these passages, faulty cleaning may occur.

Furthermore, in a region outside the image forming region and corresponding to 7.5 mm at the end portion side in the longitudinal direction of the blade 16*a*, since the amount of toner which is supplied is small, the abrasion of the blade 16*a* is likely to occur. Here, if, to prevent or reduce abrasion at the end portion side of the blade 16*a*, the contact pressure of the blade 16*a* is set weak over the entire region in the longitudinal direction, faulty cleaning may occur for the following reason. More specifically, at the central portion side corresponding to the inside of the image forming region, the contact pressure of the blade 16*a* with respect to the intermediate transfer belt 10 becomes insufficient and, thus, the rolled-in amount M of the blade 16*a* becomes small, so that toner remaining on the intermediate transfer belt 10 after secondary transfer may slip through the blade 16*a*.

<Adjustment of Dynamic Friction Coefficient of Intermediate Transfer Belt 10)

In the first embodiment, with respect to the width direction of the intermediate transfer belt 10, a dynamic friction coefficient in a first region of the intermediate transfer belt 10 which is in contact with the end portion side of the blade 16*a* is set smaller than a dynamic friction coefficient in a second region of the intermediate transfer belt 10 which is in contact with the central portion side of the blade 16*a*. Specifically, the widths of a plurality of grooves which is formed with respect to the width direction of the intermediate transfer belt 10 are set equal to each other, and the number of grooves which are formed in the first region at the end portion side is set larger than the number of grooves which are formed in the second region at the central portion side. This makes the contact area between the intermediate transfer belt 10 and the blade 16*a* in the first region smaller than that in the second region, thus lowering the dynamic friction coefficient in the first region, so that the abrasion at the end portion side of the blade 16*a* is prevented or reduced. Furthermore, the comparison in contact area between the first region and the second region is assumed to be made based on values obtained per four sides of the same unit length (per four sides of a predetermined unit length).

More specifically, intervals of a plurality of grooves which is formed on the intermediate transfer belt 10 are made different between 25 mm at the end portion side (first region) of the intermediate transfer belt 10 corresponding to 22.5 mm at the end portion side of the blade 16*a* and 200 mm at the central portion side (second region) of the intermediate transfer belt 10. In other words, in 25 mm at the end portion side of the intermediate transfer belt 10, the groove interval is set narrow and the density of a plurality of grooves is set high, so that the contact area between the blade 16*a* and the intermediate transfer belt 10 is decreased to lower the dynamic friction coefficient.

Figure 5:
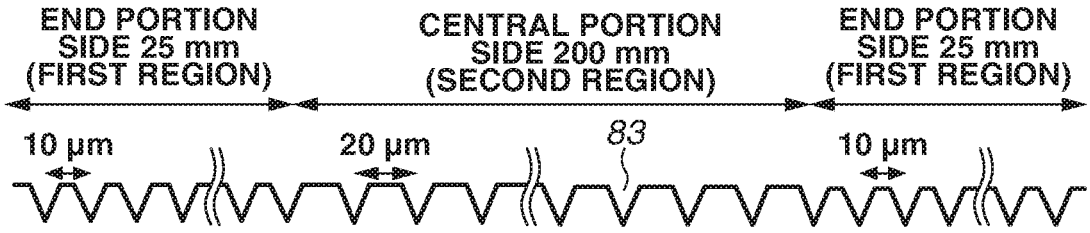
FIG. 5 is a schematic view illustrating an example configuration of grooves formed on an intermediate transfer belt in the first embodiment.
Figure 6:
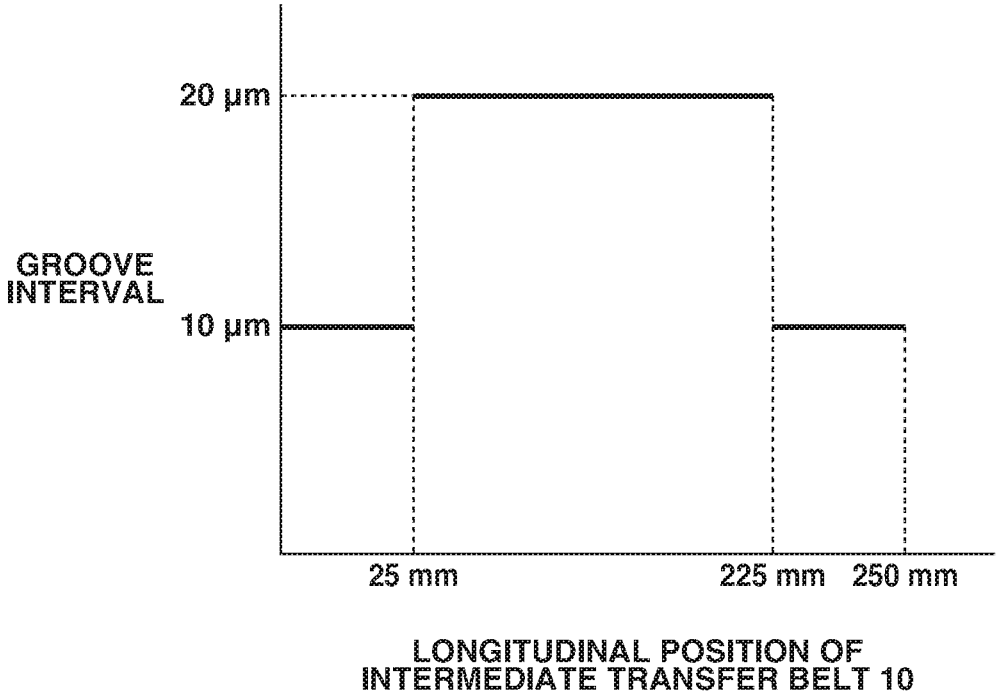
FIG. 6 is a schematic view illustrating an example configuration in which groove intervals are made different with respect to the width direction of the intermediate transfer belt in the first embodiment.

FIG. 5 is a schematic view illustrating a plurality of grooves 83 formed on the intermediate transfer belt 10 in the first embodiment to explain an interval between adjacent grooves 83 (hereinafter simply referred to as a "groove interval"). Moreover, FIG. 6 is a graph illustrating, in the intermediate transfer belt 10 in the first embodiment, a relationship between the longitudinal position of the intermediate transfer belt 10 and the groove interval with regard to a plurality of grooves 83 which extends along the movement direction of the intermediate transfer belt 10 and is formed with respect to the width direction of the intermediate transfer belt 10. As illustrated in FIG. 5 and FIG. 6, as specific groove intervals, the groove interval in 200 mm at the central portion side, which was the second region, was set to 20 μm and the groove interval in 25 mm at the end portion side, which was the first region, was set to 10 μm. Furthermore, as illustrated in FIG. 5, in the first example embodiment, with regard to a plurality of grooves 83 which is formed in the first region and the second region, all of the widths (groove widths) of opening portions of grooves 83 in the width direction of the intermediate transfer belt 10 were set equal to each other, i.e., to 2 μm.

Here, the method for forming grooves 83 on the surface of the intermediate transfer belt 10 includes various methods, such as polishing processing, cutting work, and imprinting work. The intermediate transfer belt 10 on the surface of which the grooves 83 are formed in the first embodiment can be obtained by appropriately selecting and using a desired one of the above-mentioned methods. Among the various methods, from the viewpoint of processing cost and productivity, it is favorable to perform imprinting work, in which a photo-curable property of acrylic resin serving as a base material having a microfabricated surface is utilized. Moreover, the grooves can be formed by applying lapping processing after the acrylic resin is cured.

In the first embodiment, the grooves 83 are formed on the surface of the intermediate transfer belt 10 by performing imprinting work, which presses a die with fine recessed and raised shapes formed thereon to the superficial layer 81 of the intermediate transfer belt 10 and transfers the fine recessed and raised shapes of the die to the surface of the intermediate transfer belt 10. Furthermore, in the first embodiment, a configuration in which the grooves 83 were formed over the entire circumferential area of the intermediate transfer belt 10 along the movement direction of the intermediate transfer belt 10 was employed.

Figure 7A:
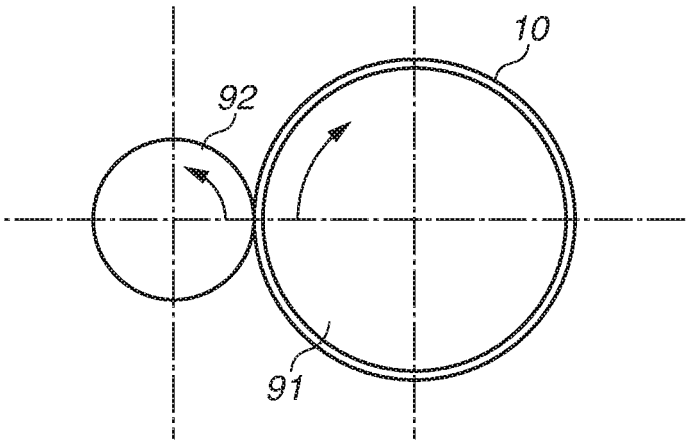
FIGS. 7A, 7B, and 7C are schematic views illustrating an example method of forming grooves on the surface of the intermediate transfer belt in the first embodiment.
Figure 7B:
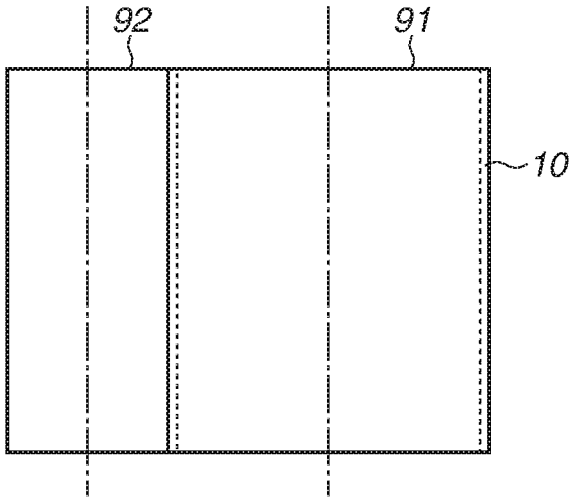
Figure 7C:
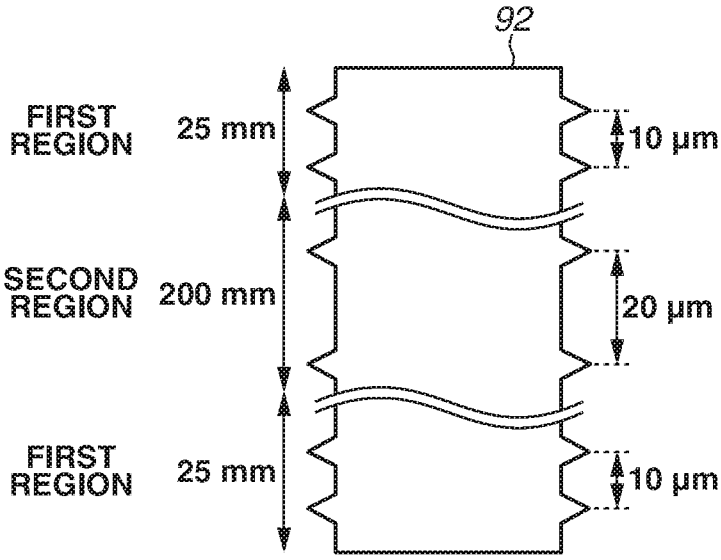

The details of the method for imprinting work used in the first example embodiment are described as follows with reference to FIGS. 7A, 7B, and 7C. FIG. 7A is a schematic view illustrating an imprinting work apparatus as viewed from the upper side in the cylindrical axis direction of the intermediate transfer belt 10. FIG. 7B is an outline sectional view of the imprinting work apparatus taken along a direction parallel to the cylindrical axis of the intermediate transfer belt 10. FIG. 7C is a sectional view of a die 92 which is used for imprinting work.

In the case of forming the grooves 83 by imprinting work, first, the method press-fits the intermediate transfer belt 10, in which the superficial layer 81 has been formed on the base layer 82, onto a core cylinder 92 (with a diameter of 227 mm, made from carbon tool steel). Then, while pressing a cylindrical die 91 with a diameter of 50 mm and a length of 250 mm against the surface of the press-fitted intermediate transfer belt 10 at a predetermined pressing force, the method rotates the core cylinder 91 to perform processing over the entire area of the longitudinal width of 250 mm of the intermediate transfer belt 10.

Moreover, in the case of forming the grooves 83 on the intermediate transfer belt 10, the die 92 is heated by a heater (not illustrated) to a temperature of 130° C., which is 5° C. to 15° C. higher than the glass-transition temperature of polyethylene naphthalate. Then, while bringing the heated die 92 into contact with the core cylinder 91, the method rotates the core cylinder 91 one rotation at a circumferential velocity of 264 mm/s and, after that, releases the die 92 from the core cylinder 91. Furthermore, during a period in which the core cylinder 91 is rotated, the die 92 is rotated while being driven by the rotation of the core cylinder 91. In the first embodiment, the surface profile processing was performed in the above-described way to form the grooves 83 on the superficial layer 81 of the intermediate transfer belt 10.

As illustrated in FIG. 7C, on the surface of the die 92, there are formed a first region (25 mm), in which triangle-shaped raised portions are formed at equal intervals of 10 μm, and a second region (200 mm), in which triangle-shaped raised portions are formed at equal intervals of 20 μm, in parallel to the circumferential direction of the cylinder. The first region is formed at each of both end regions with respect to the longitudinal direction of the die 92. Each triangle-shaped raised portion is formed by cutting work in such a manner that the length of the bottom of the raised portion becomes 2.0 μm and the height thereof becomes 2.0 μm. Performing the above-described imprinting work using the die 92 having such a shape enables obtaining the intermediate transfer belt 10 having a surface profile illustrated in FIG. 5.

Next, dynamic friction coefficients were compared with use of the first embodiment, a comparative example 1, and a comparative example 2. The comparative example 1 has a configuration in which no grooves extending along the movement direction of the intermediate transfer belt are formed, and the comparative example 2 has a configuration in which a plurality of grooves extending along the belt conveyance direction is formed at intervals of 20 μm with respect to the width direction of the intermediate transfer belt over the entire area of the intermediate transfer belt. Furthermore, in the following description, portions of the configurations of the comparative example 1 and the comparative example 2 similar to those of the first embodiment are omitted from description.

Each dynamic friction coefficient was measured with use of, for example, a surface texture measurement device ("HEIDON 14FW" manufactured by Shinto Scientific Co., Ltd.). As a measurement indenter, a ball indenter made from urethane (with an outer diameter of ⅜ inches and a rubber hardness of 90 degrees) was used. The measurement thereof was performed under the condition that the test load was 50 gf, the velocity was 10 mm/sec, and the measurement distance was 50 mm. A value obtained by dividing an average value of frictional forces (gt) measured from 0.4 seconds to 1 second after the start of measurement by the test load (gf) was treated as each dynamic friction coefficient.

The result of such dynamic frictional force measurement is set forth in the following table 1.

TABLE 1

| | | Groove interval [μm] | Dynamic friction coefficient |
|---|---|---|---|
| Comparative example 1 | | 0 (no grooves) | 0.95 |
| Comparative example 2 | | 20 | 0.7 |
| First embodiment | Central portion side | 20 | 0.7 |
| | End portion side | 10 | 0.67 |

As shown in Table 1, in the configuration of the comparative example 1, in which there are no grooves, since the dynamic friction coefficient is large, turning-up of the blade is likely to occur due to the movement of the intermediate transfer belt. Moreover, in the configuration of the comparative example 2, although turning-up of the blade is prevented or reduced by forming a plurality of grooves, the amount of abrasion is likely to become uneven between the end portion side and the central portion side of the blade. According to the studies by the inventors, when an endurance evaluation in which images were formed on a plurality of transfer materials P was carried out, in the configuration of the first embodiment, the occurrence of faulty cleaning was not observed. On the other hand, in the configurations of the comparative example 1 and the comparative example 2, since, due to the abrasion or turning-up of the blade, toner slipped through the blade nip portion, faulty cleaning occurred.

Here, it is favorable that the rolled-in amount M of the blade 16*a* for performing cleaning of toner is 5 μm from the fore-end of the blade. Therefore, in the configuration of the central portion side, the contact area between the intermediate transfer belt 10 and the blade 16*a* only needs to be 90% of the entire region, so that the groove width can be 2 μm and the groove interval can be 20 μm. On the other hand, at the end portion side, since it is necessary to lower the dynamic friction coefficient, to decrease the contact area between the intermediate transfer belt 10 and the blade 16*a* to 80% of the entire region, the groove width is set to 2 μm and the groove interval is set to 10 μm.

Since the dynamic friction coefficient varies depending on the contact area between the intermediate transfer belt 10 and the blade 16*a*, the contact area also has a range of upper and lower limits. As the range of contact areas between the intermediate transfer belt 10 and the blade 16*a*, it is favorable that the contact area is 50% or more and 97% or less. If the contact area between the intermediate transfer belt 10 and the blade 16*a* is too small, the frictional force of the blade 16*a* becomes small, so that slipping-through of toner may occur. Moreover, conversely, if the contact area is too large, since the dynamic friction coefficient itself does not lower, turning-up may occur or a decrease in cleaning performance with long-term use may occur.

From the above-mentioned results, according to the configuration of the first embodiment, setting the groove interval wider in the second region at the central portion side and narrower in the first region at the end portion side enables lowering the dynamic friction coefficient only at the end portion side. As a result, it is possible to, while adjusting the desired rolled-in amount M of the blade 16*a*, prevent or reduce a difference from occurring in the amount of abrasion between the central portion side and the end portion side of the blade 16*a* and, thus, to prevent or reduce the occurrence of faulty cleaning.

Furthermore, in the first embodiment, a configuration in which the dynamic friction coefficient is made different between the first region of the intermediate transfer belt 10, which is a region formed outside the image forming region, and the second region thereof, which is a region formed inside the image forming region, has been described. However, the first embodiment is not limited to this, but the first region can be a region formed outside the region in which the development aperture is formed and the second region can be a region formed inside the region in which the development aperture is formed.

As mentioned in the above description, the blade 16*a* extends to outside the development aperture with respect to the width direction of the intermediate transfer belt 10. Moreover, while, in a region outside the image forming region and inside the region in which the development aperture is formed, toner may be slightly supplied, in a region outside the region in which the development aperture is formed, toner is hardly supplied. Accordingly, as in the first embodiment, grooves can be formed on the intermediate transfer belt 10 in such a manner that the contact area between the intermediate transfer belt 10 and the blade 16*a* is smaller in a region outside the region in which the development aperture is formed than in a region inside the region in which the development aperture is formed. This enables attaining an advantageous effect similar to that in the first embodiment.

In the above first embodiment, a configuration in which the groove widths of a plurality of grooves 83 formed on the superficial layer 81 of the intermediate transfer belt 10 are set equal to each other and the groove interval formed in the first region at the end portion side of the intermediate transfer belt 10 is made different from the groove interval formed in the second region at the central portion side of the intermediate transfer belt 10 has been described. On the other hand, in a second embodiment, the groove intervals of a plurality of grooves formed on the superficial layer of an intermediate transfer belt 110 are set equal to each other and the groove width formed in the first region at the end portion side of the intermediate transfer belt 110 is made different from the groove width formed in the second region at the central portion side of the intermediate transfer belt 110. Furthermore, in the second embodiment, portions similar to those in the first example embodiment are assigned the respective same reference characters and are, therefore, omitted from description.

Figure 8:
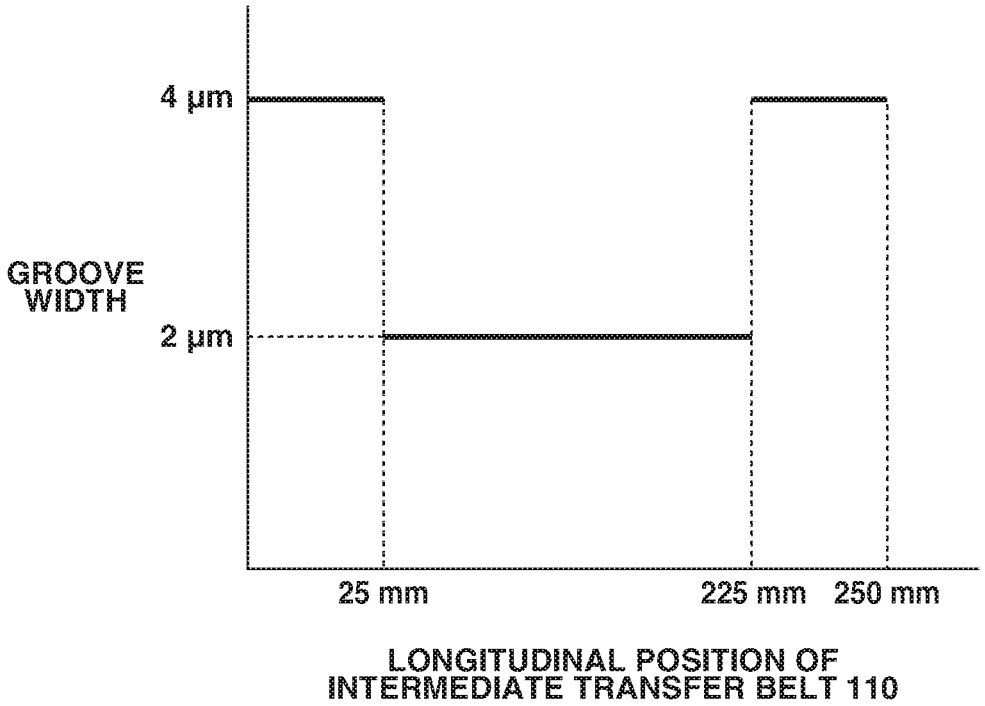
FIG. 8 is a schematic view illustrating an example configuration in which groove widths of the respective grooves are made different with respect to the width direction of the intermediate transfer belt in a second embodiment.

FIG. 8 is a graph illustrating, in the intermediate transfer belt 110 in the second embodiment, a relationship between the longitudinal position of the intermediate transfer belt 110 and the groove width with regard to a plurality of grooves which extends along the movement direction of the intermediate transfer belt 110 and is formed with respect to the width direction of the intermediate transfer belt 110. As illustrated in FIG. 8, in the second embodiment, with respect to the width direction of the intermediate transfer belt 110, the groove width in a region (first region) formed outside the image forming region is set wider than the groove width in a region (second region) formed inside the image forming region. As specific groove widths, the groove width in 200 mm at the central portion side, which was the second region, was set to 2 μm and the groove width in 25 mm at the end portion side, which was the first region, was set to 4 μm. Furthermore, in the second embodiment, with regard to a plurality of grooves which is formed in the first region and the second region, all of the groove intervals in the width direction of the intermediate transfer belt 110 were set equal to each other, i.e., to 20 μm.

The above-described configuration enables making the contact area between the intermediate transfer belt 110 and the blade 16*a* smaller in the first region than in the second region to decrease the dynamic friction coefficient, thus preventing or reducing the abrasion at the end portion side of the blade 16*a*. Accordingly, even the configuration of the second embodiment enables attaining an advantageous effect similar to that in the first embodiment. Furthermore, the comparison in contact area between the first region and the second region is assumed to be made based on values obtained per four sides of the same unit length (per four sides of a predetermined unit length).

Here, in the case of making the dynamic friction coefficient different between the central portion side and the end portion side of the intermediate transfer belt 110 by changing the groove width, besides the contact area between the blade 16*a* and the intermediate transfer belt 110, there is a range of favorable groove widths and it is favorable that the groove width is set to 0.5 μm or more and 4 μm or less. If the groove width is wider than 4 μm, toner, which is targeted for cleaning, falls in the grooves and, thus, slips through the blade nip portion Nb, so that faulty cleaning may occur. Since the size of toner is at least 5 μm in diameter, it is favorable that the groove width is up to 4 μm, which is less than the size of toner. On the other hand, if the groove width is smaller than 0.5 μm, it becomes difficult to form such a groove shape on the intermediate transfer belt 110, so that it becomes difficult to accomplish the purpose of decreasing the contact area between the intermediate transfer belt 110 and the blade 16*a*. For the above reasons, it is favorable that the groove width is set to 0.5 μm or more and 4 μm or less, and, furthermore, it is more favorable that the groove width is set to 0.5 μm or more and 3 μm or less.

Furthermore, while, in the first and second embodiments, the dynamic friction coefficient of the intermediate transfer belt 10 or 110 is made different between the inside of the image forming region and the outside of the image forming region, the first and second embodiments are not limited to this. As also described in the first embodiment, the first region and the second region can be set based on the region in which the development aperture is formed, so as to be used to change the groove width.

Figure 9:
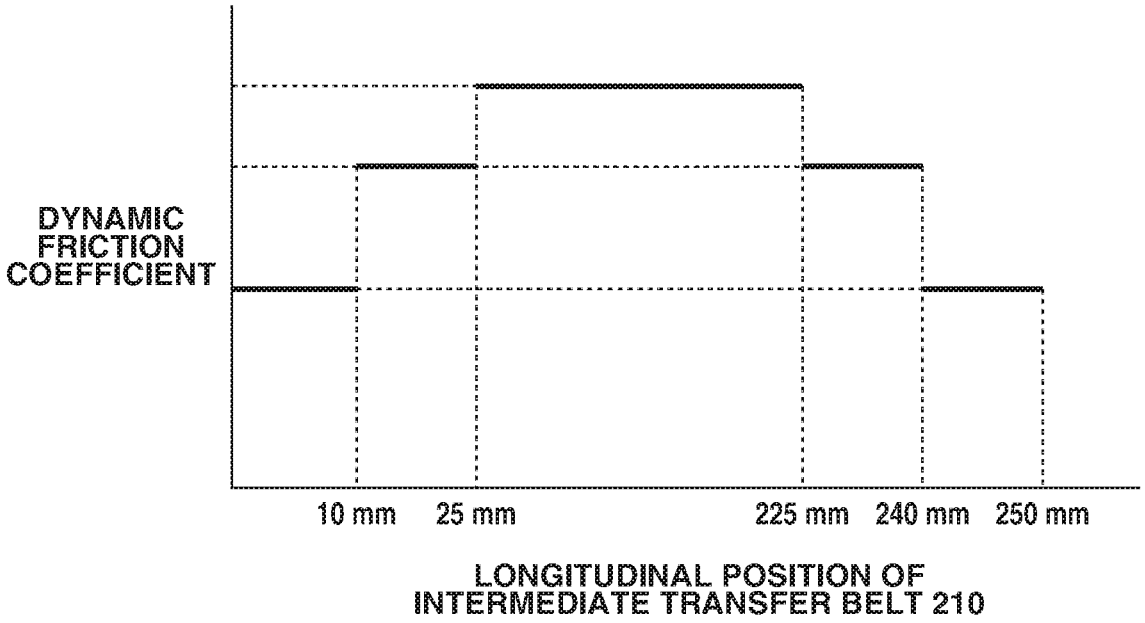
FIG. 9 is a schematic view illustrating an example configuration in which dynamic friction coefficients are made different with respect to the width direction of the intermediate transfer belt in a modification example of the second embodiment.

FIG. 9 is a graph illustrating, in an intermediate transfer belt 210 in a modification example of the second embodiment, a relationship between the longitudinal position of the intermediate transfer belt 210 and the dynamic friction coefficient in each region. As illustrated in FIG. 9, in the modification example, in 10 mm at the end portion side of the intermediate transfer belt 210 (first region), in which toner is hardly supplied, the dynamic friction coefficient of the intermediate transfer belt 210 is, therefore, set low. Then, in 200 mm at the central portion side of the intermediate transfer belt 210 (second region), in which toner is supplied, the dynamic friction coefficient of the intermediate transfer belt 210 is, therefore, set higher than in the first region. Moreover, in a third region corresponding to between the first region and the second region with respect to the width direction of the intermediate transfer belt 210, since there is the possibility that a slight amount of toner moves from the development aperture to the photosensitive drum 1, the dynamic friction coefficient is set to a value between those in the first region and the second region.

As described above, in the configuration of the modification example, the dynamic friction coefficient is made different in a step-by-step manner in the longitudinal position with respect to the intermediate transfer belt 210, and performing designing in such a manner enables attaining an advantageous effect similar to those in the first embodiment and the second embodiment. Furthermore, the method for making the dynamic friction coefficient different includes a method of changing the groove width or the groove interval.

In the first embodiment and the second embodiment, a configuration in which the contact area between the intermediate transfer belt 10 or 110 and the blade 16*a* is adjusted by forming a plurality of grooves on the superficial layer 81 of the intermediate transfer belt 10 or 110 has been described. On the other hand, in a third embodiment, a configuration in which recessed and raised portions are formed on the surface of an intermediate transfer belt 310 by polishing the intermediate transfer belt 310 so that the contact area between the intermediate transfer belt 310 and the blade 16*a* is adjusted is described. Furthermore, in the third embodiment, portions similar to those in the first embodiment are assigned the respective same reference characters and are, therefore, omitted from description.

Figure 10:
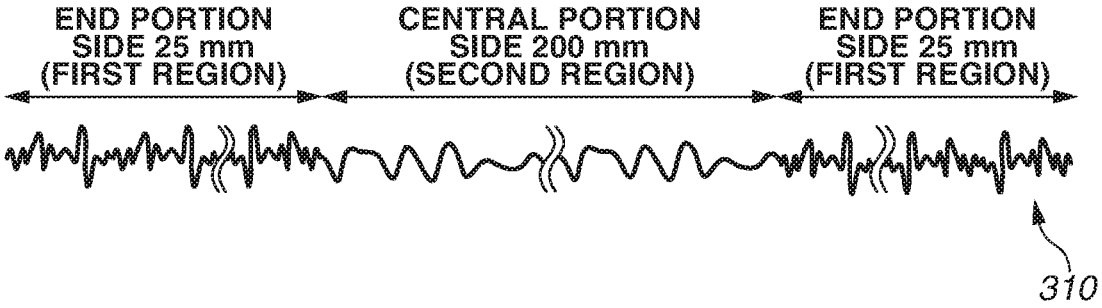
FIG. 10 is a schematic view illustrating a surface profile of the intermediate transfer belt in a third embodiment.

FIG. 10 is a schematic view illustrating the surface profile of the intermediate transfer belt 310 in the third embodiment. In the third embodiment, with respect to the width direction of the intermediate transfer belt 310, the surface roughness of the superficial layer in the first region, which is at the end portion side of the intermediate transfer belt 310, is set rougher than the surface roughness of the superficial layer in the second region, which is at the central portion side thereof. This causes the dynamic friction coefficient in the first region to be smaller than the dynamic friction coefficient in the second region.

The method of making the roughness of the surface different is specifically described as follows. First, with respect to the width direction of the intermediate transfer belt 310, the method polishes the entire longitudinal region, thus performing roughness formation on the surface of the entire longitudinal region. At this time, while bringing a lapping film into contact with the intermediate transfer belt 310, the method can rotate the intermediate transfer belt 310 to polish the surface thereof. Next, to further apply roughness to the region in 25 mm at the end portion side (first region), the method re-performs polishing only on the region in 25 mm at the end portion side. This enables obtaining an intermediate transfer belt 310 in which the surface roughness in the first region is set rougher than the surface roughness in the region in 200 mm at the central portion side (second region).

Next, specific numerical values of roughness are described. The measurement of the surface roughness was made with use of a surface texture and contour measuring instrument SURFCOM 1500SD (manufactured by TOKYO SEIMITSU CO., LTD.) under the condition that, in compliance with the standard JIS B0601: 2001, the cutoff wavelength was 0.25 mm, the measurement criterion length was 0.25 mm, and the measurement length was 1.25 mm. Here, the ten-point average roughness Rzjis of the superficial layer of the intermediate transfer belt 310 was a result obtained by causing a probe of the measuring instrument to perform scanning in directions perpendicular to the movement direction of the surface of the intermediate transfer belt 310 and calculating an average value of values obtained in at least five optional portions.

From the measurement result, in the second region, in which the contact area between the intermediate transfer belt 310 and the blade 16*a* was 90%, the ten-point average roughness Rzjis serving as the surface roughness was 0.35 μm. Moreover, in the first region, in which the contact area between the intermediate transfer belt 310 and the blade 16*a* was 80%, the ten-point average roughness Rzjis serving as the surface roughness was 0.65 μm. Furthermore, the comparison in contact area between the first region and the second region is assumed to be made based on values obtained per four sides of the same unit length (per four sides of a predetermined unit length).

In this way, according to the configuration of the third embodiment, setting the surface roughness in the first region rougher than the surface roughness in the second region enables attaining an advantageous effect similar to those in the first embodiment and the second embodiment.

While, in the third embodiment, a configuration in which the surface roughness in the first region is made different from that in the second region by polishing the superficial layer of the intermediate transfer belt 310 has been described, the third embodiment is not limited to this. For example, in a case where roughening particles are added to the superficial layer of the intermediate transfer belt, the surface roughness can be made different in the respective regions by making the amount of deposition of the particles on the surface of the intermediate transfer belt different.

As the specific method, the thickness of the superficial layer of the intermediate transfer belt is set to 1 μm in the first region in 25 mm at the end portion side and is set to 2 μm in the second region at the central portion side, so that the state of deposition of the roughening particles added to the superficial layer can be made different. In this case, the amount of deposition of roughening particles in the first region becomes larger than the amount of deposition of roughening particles in the second region, so that an intermediate transfer belt exhibiting a tendency similar to that in the third embodiment in a case where the ten-point average roughness has been measured can be obtained. Furthermore, as the method of making the thickness of the superficial layer different, the time of application of the superficial layer to the base layer can be changed in such a manner that such a time of application is set to a short time at the end portion side and is set to a long time at the central portion side.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-078712 filed Apr. 16, 2018, which is hereby incorporated by reference herein in its entirety.

What is claimed is:

1. An image forming apparatus comprising:

an image bearing member configured to bear a toner image;

a movable intermediate transfer member being in contact with the image bearing member and allowing the toner image borne on the image bearing member to be primarily transferred thereto; and a contact member provided at a downstream side of a secondary transfer portion, which secondarily transfers the toner image primarily transferred to the intermediate transfer member from the intermediate transfer member to a transfer material, with respect to a movement direction of the intermediate transfer member, the contact member being in contact with the intermediate transfer member, and being configured to recover toner remaining on the intermediate transfer member after passing through the secondary transfer portion, wherein, with respect to a width direction perpendicular to the movement direction, a width of the contact member is larger than a width of an image forming region in which a toner image is able to be primarily transferred from the image bearing member to the intermediate transfer member, and wherein a plurality of grooves extending along the movement direction is formed on the intermediate transfer member with respect to the width direction, and a dynamic friction coefficient in a first region that is in contact with an end portion side of the contact member with respect to the width direction is smaller than a dynamic friction coefficient in a second region that is in contact with a central portion side of the contact member with respect to the width direction.

2. The image forming apparatus according to claim 1, wherein, with respect to the width direction, the first region is a region formed outside the image forming region, and the second region is a region formed inside the image forming region.

3. The image forming apparatus according to claim 1, further comprising a developing unit configured to develop a toner image onto the image bearing member, and including a developing container configured to contain toner, an aperture portion provided at the developing container, and a development member configured to bear toner contained in the developing container, the developing unit developing a toner image onto the image bearing member by the development member bearing toner suppled from the developing container via the aperture portion being in contact with the image bearing member, wherein, with respect to the width direction, the width of the contact member is larger than a width of the aperture portion, the first region is a region formed outside a region in which the aperture portion is formed, and the second region is a region formed inside the region in which the aperture portion is formed.

4. The image forming apparatus according to claim 1, wherein a contact area between the contact member and the intermediate transfer member at a basic unit of predetermined length square in the first region is smaller in value than a contact area between the contact member and the intermediate transfer member at the basic unit of predetermined length square in the second region.

5. The image forming apparatus according to claim 1, wherein, with regard to the plurality of grooves, widths of opening portions of the grooves with respect to the width direction are equal to each other, and an interval between adjacent ones of the grooves in the width direction is narrower in the first region than in the second region.

6. The image forming apparatus according to claim 1, wherein, with regard to the plurality of grooves, intervals between respective adjacent ones of the grooves in the width direction are equal to each other, and a width of an opening portion of each of the grooves with respect to the width direction is wider in the first region than in the second region.

7. The image forming apparatus according to claim 6, wherein the width of the opening portion of each of the grooves in the width direction is 0.5 μm or more and 4 μm or less.

8. The image forming apparatus according to claim 1, wherein the intermediate transfer member includes a base layer, which is the thickest layer among a plurality of layers constituting the intermediate transfer member with respect to a thickness direction of the intermediate transfer member and which has an ion conductive agent added thereto, and a superficial layer formed on a surface of the base layer, and the plurality of grooves is formed on the superficial layer.

9. The image forming apparatus according to claim 1, wherein a surface roughness of the intermediate transfer member in the first region is rougher than a surface roughness thereof in the second region.

10. The image forming apparatus according to claim 9, wherein the intermediate transfer member includes a base layer, which is the thickest layer among a plurality of layers constituting the intermediate transfer member with respect to a thickness direction of the intermediate transfer member and which has an ion conductive agent added thereto, and a superficial layer formed on a surface of the base layer and having roughening particles dispersed thereon, and wherein a thickness of the superficial layer in the first region is less than a thickness of the superficial layer in the second region, and an amount of deposition of the roughening particles in the first region is larger than an amount of deposition of the roughening particles in the second region.

11. The image forming apparatus according to claim 1, wherein the contact member is a blade formed from polyurethane.

12. The image forming apparatus according to claim 1, wherein the contact member is in contact with the intermediate transfer member in such a way as to face in a counter direction.

* * * * *